US009975027B2

(12) United States Patent
Fike

(10) Patent No.: US 9,975,027 B2
(45) Date of Patent: May 22, 2018

(54) WEIGHTED KICKBOARD

(71) Applicant: James Fike, Fort Worth, TX (US)

(72) Inventor: James Fike, Fort Worth, TX (US)

( * ) Notice: Subject to any disclaimer, the term of this patent is extended or adjusted under 35 U.S.C. 154(b) by 9 days.

(21) Appl. No.: 14/606,870

(22) Filed: Jan. 27, 2015

(65) Prior Publication Data

US 2016/0213992 A1 Jul. 28, 2016

(51) Int. Cl.

| | |
|---|---|
| ***A63B 69/14*** | (2006.01) |
| ***A63B 21/06*** | (2006.01) |
| *A63B 71/06* | (2006.01) |

(52) U.S. Cl.

CPC ..... *A63B 69/14* (2013.01); *A63B 21/0606* (2013.01); *A63B 71/0622* (2013.01); *A63B 2071/0694* (2013.01); *A63B 2207/02* (2013.01); *A63B 2208/03* (2013.01); *A63B 2209/00* (2013.01); *A63B 2220/16* (2013.01); *A63B 2220/18* (2013.01); *A63B 2220/40* (2013.01); *A63B 2220/833* (2013.01); *A63B 2225/605* (2013.01)

(58) Field of Classification Search

CPC ..... A63B 21/00069; A63B 21/0084; A63B 69/12; A63B 69/14; A63B 2225/605; B63B 35/7903; B63B 35/7906; B63B 35/7909; B63B 35/7913; B63B 35/7916

USPC ..... 441/65; 434/254; 482/55

See application file for complete search history.

(56) References Cited

U.S. PATENT DOCUMENTS

| | | | | |
|---|---|---|---|---|
| 3,124,815 A * | 3/1964 | Harvey | A63B 69/12 | 441/55 |
| 3,414,919 A * | 12/1968 | Gust | B63L 335/7906 | 441/74 |
| 4,406,628 A * | 9/1983 | Rademacher | A63B 69/14 | 428/178 |
| 4,518,364 A * | 5/1985 | Jacobson | A63B 69/14 | 434/254 |
| 4,781,638 A * | 11/1988 | Winters, Jr. | B63B 35/73 | 434/254 |
| 4,798,549 A * | 1/1989 | Hirsch | B29C 44/385 | 114/39.14 |
| 4,949,645 A * | 8/1990 | Hayward | A01K 95/005 | 102/459 |
| 4,964,825 A * | 10/1990 | Paccoret | B63B 35/7906 | 114/39.14 |
| 5,802,642 A * | 9/1998 | Slaughter | A47C 27/146 | 182/230 |
| 5,928,045 A * | 7/1999 | Szabad | A63C 5/03 | 280/602 |
| 6,402,578 B1 * | 6/2002 | Zappitelli | B63B 35/7909 | 114/357 |
| 6,561,958 B2 * | 5/2003 | Pappert | A63B 21/06 | 482/105 |

(Continued)

FOREIGN PATENT DOCUMENTS

DE 2829380 A1 * 1/1980 ..... B63B 35/7906

*Primary Examiner* — Ajay Vasudeva

(74) *Attorney, Agent, or Firm* — Damon R. Hickman Law Firm, P.C.

(57) ABSTRACT

A kickboard containing a low density member and a high density member, the kickboard having a weight configured that the kickboard does not float on a body of water and does not sink to the bottom of a body of water thereby providing swimmers with greater resistance during swimming as the weighed kickboard requires more force from the user to maintain proper position.

11 Claims, 4 Drawing Sheets

(56) References Cited

U.S. PATENT DOCUMENTS

| | | | | |
|---|---|---|---|---|
| 6,669,519 | B2 * | 12/2003 | Metrot | B63B 35/7909<br>114/357 |
| 7,892,058 | B1 * | 2/2011 | Echecopar | B63B 35/7906<br>441/65 |
| 2003/0008575 | A1 * | 1/2003 | Leonard | B63B 35/7906<br>441/65 |
| 2006/0270288 | A1 * | 11/2006 | Hayward | B63B 35/7909<br>441/74 |
| 2009/0111667 | A1 * | 4/2009 | DiMucci, III | A63B 21/065<br>482/105 |
| 2011/0023762 | A1 * | 2/2011 | Chen | A63C 5/12<br>114/39.14 |

* cited by examiner

WEIGHTED KICKBOARD

BACKGROUND

1. Field of the Invention

The present invention relates generally to swimmer's aids, and more specifically to a system and method for swimming with a weighted kickboard.

2. Description of Related Art

Kickboards are buoyant, typically made of blue foam, and are used by swimmers to provide flotation for their forearms and hands. Standard kickboards statically float above the surface of the pool. Kickboards normally have a rounded forward edge and a squared off back edge along with an upper surface and a lower surface. Current kickboards are used by the swimmer grabbing an edge of the kickboard, resting their forearms on the upper surface of the kickboard, and then kicking their legs to provide motion. A kickboard is a buoyant object used to condition the user's legs to kick stronger and faster, and gives the swimmer a stronger kick while swimming, enabling the user to generate more propulsion from the legs and swim faster. A user holds a kickboard at the front edge or along the sides, extends one's legs away from the board, and moves the legs to propel themselves forward. The kickboard reacts to the swimmer by pushing upwards because the kickboard is lighter than the water it displaces. Current kickboards do not provide swimmers with both upwards and downwards reactive forces because of the buoyancy of current kickboards. While there are many systems for kickboards well known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
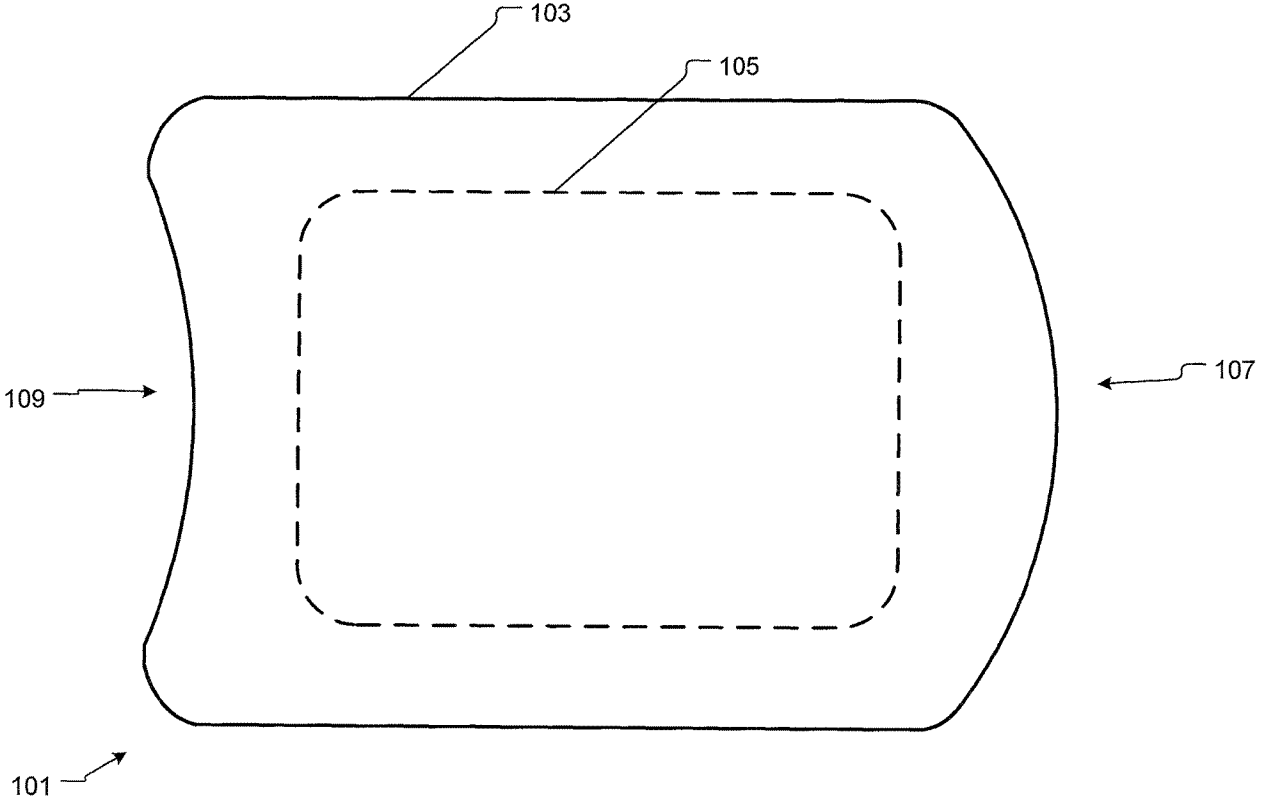
FIG. 1 is a plan view of a weighted kickboard according to the present application is illustrated according to the present application.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the apparatus for a weighted kickboard are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Regular kickboards as described above, merely float on water and provide limited resistance to users of them. Regular kickboards have a density less than the body of water they are used in so they float on top of the body of water. The limited resistance of regular kickboards is a result of the user only having to react to the regular kickboard's attempt to stay on top of the body of water.

Improved kickboards, that are weighted, have lower buoyancy and higher density than regular kickboards and do not float on the top of a body of water. It should be apparent that weighted kickboards are used in swimming pools and such where the water temperature is above freezing. Referring now to FIG. 1 in the drawings, a plan view of a weighted kickboard according to the present application is illustrated. Kickboard 101 has a low density member 103 with a density in the range of 20 kg/m$^3$ to 400 kg/m$^3$, typically fabricated from ethylene-vinyl acetate (EVA) expanded foam, for holding one's hands extended from a body while swimming. Alternatively, low density member 103 is fabricated from polyethylene foam (PE). Kickboard 101 also includes a high density member 105 with a density in the range of 6,000 kg/m$^3$ to 23,000 kg/m$^3$. Kickboard 101 is configured by high density member 105 to statically float underneath the surface of a swimming pool such that only the top surface of the kickboard is above the waterline of the pool without any force applied to it by a user. When a user applies a downward force through the use of the kickboard, the kickboard then floats a few inches below the surface or waterline of the pool.

Kickboard 101 has a leading edge 107 and a trailing edge 109. Leading edge 107 is rounded to decrease the water's resistance around the kickboard 101 as the kickboard is propelled through a body of water. Trailing edge 109 curves inward towards the center of the kickboard 101.

High density member 105 in the preferred embodiment is a steel plate of approximately 6 pounds and approximately one-third of an inch thick. Alternative materials are contemplated for high density member 105 such as lead, tungsten, and stainless steel. Preferably the corners of high density member 105 are rounded to minimize any shearing of the member 103. Over time any sharp corners of high density member 105 will penetrate member 103 and create a hazard to users.

Outer surface of the kickboard 101 is typically smooth foam. Alternatively, the outer surface of the kickboard 101 is textured. Texturing the surface of the kickboard 101 reduces the likelihood of dropping the weighed kickboard outside of the pool as the kickboard 101 will weigh at least 4 pounds. Furthermore, it is contemplated that kickboard 101 may include surface indicia or unique coloring, such as brick red surface or a textured number equal to the weight, to differentiate weighted kickboard 101 from un-weighted kickboards. The surface indicia is important as the appearance of weighted kickboard 101 will be similar to un-weighted kickboards. Unless a user picks up each and every kickboard in a pile of kickboards they would not be able to easily select the weighted kickboard 101 without the surface indicia.

Figure 2:
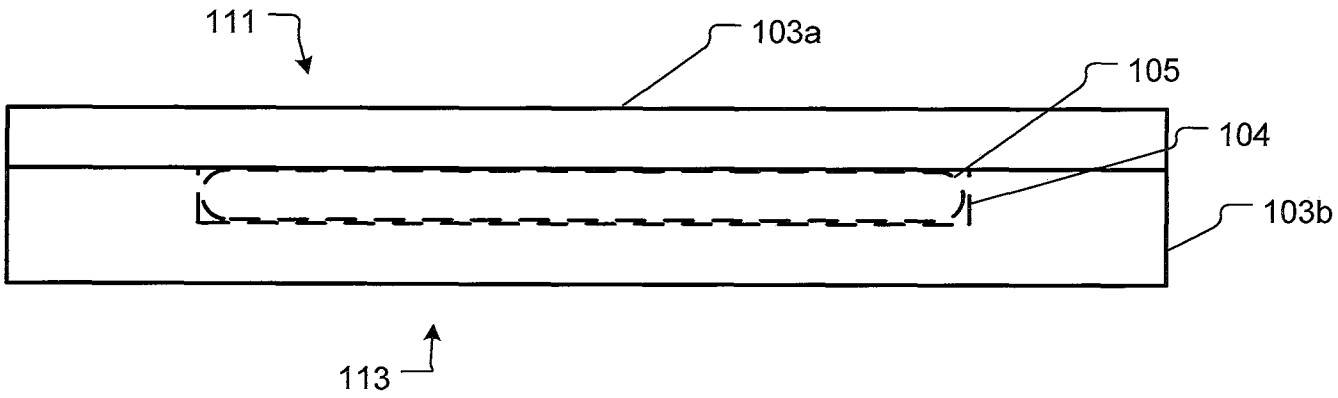
FIG. 2 is a plan view of a weighted kickboard according to the present application is illustrated according to the present application.

Referring now also to FIG. 2 in the drawings, a plan view of a weighted kickboard according to the present application is illustrated. Member 103 has a top surface 111 and a bottom surface 113 and is preferable fabricated from a first layer of foam 103*a* and a second layer of foam 103*b*. The second layer 103*b* contains a recess 104 sized to receive high density member 105. An uncured layer of epoxy is disposed between the two layers sandwiching the high density member 105 and then pressure is applied to the two layers. Once the epoxy is cured, the pressure is removed and the weighted kickboard 101 is complete. Alternatively the kickboard is comprised of three layers of foam, the center layer having the recess for the high density member 105.

Figure 3:
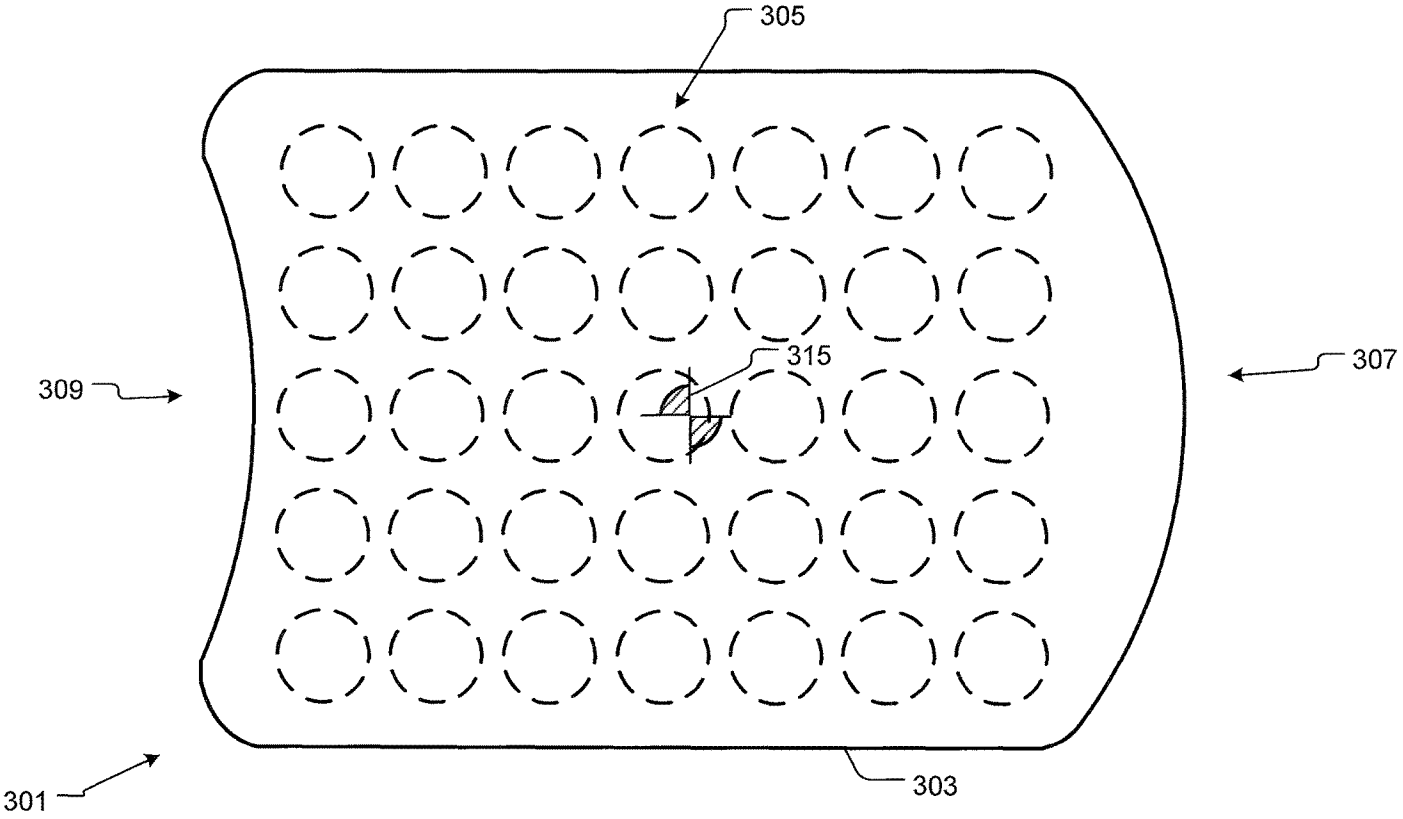
FIG. 3 is a plan view of a weighted kickboard according to the present application is illustrated according to the present application.

Referring now also to FIG. 3 in the drawings, a plan view of a weighted kickboard according to the present application is illustrated. Kickboard 301 has a member 303, typically fabricated from ethylene-vinyl acetate (EVA) expanded foam, for holding one's hands extended from a body while swimming. Kickboard 301 also includes a plurality of weights 305 having a spherical shape.

Kickboard 301 has a leading edge 307 and a trailing edge 309. Leading edge 307 is rounded to decrease the water's resistance around the kickboard 301 as the kickboard is propelled through a body of water. Trailing edge 309 curves inward towards the center of the kickboard 301.

Weights 305 in the preferred embodiment are steel ball bearings approximately three-quarters of an inch in diameter. Alternative materials are contemplated for weight 305 such as lead, tungsten, and stainless steel. Because the weights are ball bearings there are no corners of weights 305. Over time any sharp corners of weights 305 will penetrate member 303 and create a hazard to users.

The center of gravity 315 for the kickboard 301 is selectively located based upon the density of weights 305 across the kickboard 301. Placing the center of gravity 315 forward causes the kickboard 301 to dip the leading edge 307 more than kickboard 101 when used in a pool. Dipping the leading edge 307 of kickboard 301 forces a swimmer to react to a greater rotational force while swimming. Other locations center of gravity locations are contemplated by this application to provide other rotational forces to users of the kickboard 301. The location of the weights 315 arrayed across the kickboard 301 are varied in other embodiments to relocate the center of gravity, furthermore certain groups of weights can have different densities to allow for positional adjustment of the center of gravity.

Member 303 is preferable fabricated from two layers of foam. One of the layers contains a plurality of recesses sized to receive weights 305. An uncured layer of epoxy is disposed between the two layers sandwiching the weights 305 and then pressure is applied to the two layers. Once the epoxy is cured, the pressure is removed and the weighted kickboard 301 is complete. Alternatively the kickboard is comprised of three layers of foam, the center layer having the recess for the high density member 105.

Figure 4:
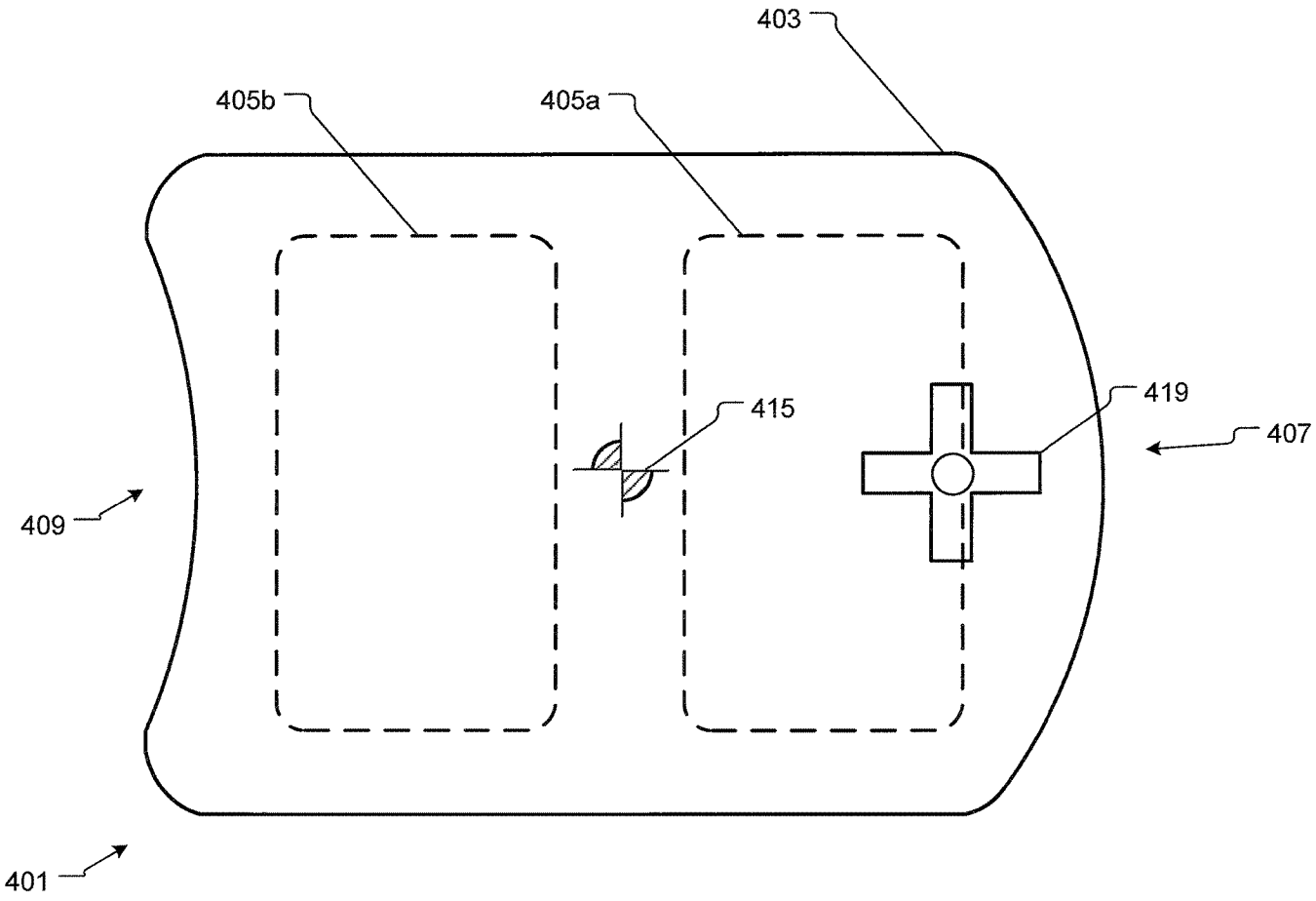
FIG. 4 is a plan view of a weighted kickboard according to the present application is illustrated according to the present application.

Referring now also to FIG. 4 in the drawings, a plan view of a weighted kickboard according to the present application is illustrated. Kickboard 401 has a member 403, typically fabricated from ethylene-vinyl acetate (EVA) expanded foam, for holding one's hands extended from a body while swimming. Kickboard 401 also includes a first weight 405*a* and a second weight 405*b*.

Kickboard 401 has a leading edge 407 and a trailing edge 409. Leading edge 407 is rounded to decrease the water's resistance around the kickboard 401 as the kickboard is propelled through a body of water. Trailing edge 409 curves inward towards the center of the kickboard 401. While the preferred embodiment of kickboard 401 has a smooth surface, this application contemplates surface texturing on the kickboard 401 to aid the grip of users both in the pool and exterior of the pool. Weighted kickboards are more difficult to handle outside a pool because of the additional mass internal to the weighted kickboard. Surface texturing reduces the likelihood the weighted kickboard is inadvertently dropped.

Weight 405 in the preferred embodiment are steel plates approximately one-fourth of an inch thick and collectively weighs 4 pounds. Alternative materials are contemplated for weight 405 such as lead, tungsten, and stainless steel. Preferably the corners of weight 405 are rounded to minimize any shearing of the member 403. Over time any sharp corners of weight 405 will penetrate member 403 and create a hazard to users. Weight 405 can be machined to add texture to the surfaces of the weight.

Kickboard 401 has a center of gravity 415 that is selective based upon at least a first mass of first weight 405*a* and a second mass of second weight 405*b*. For example, a position of the center of gravity 415 is moved towards the leading edge 407 by increasing the first mass of first weight 405*a* relative to the second mass of the second weight 405*b*. Placing the center of gravity 415 forward causes the kickboard 401 to dip the leading edge 407 more than kickboard 101 when used in a pool, e.g. a front-weighted kickboard works the upper back muscles more and a rear-weighted kickboard works the latissimus dorsi muscles more. Dipping the leading edge 407 of kickboard 401 forces a swimmer to react to a greater rotational force while swimming. Other locations center of gravity locations are contemplated by this application to provide other rotational forces to users of the kickboard 401. Indicator 419 in conjunction with a sensor provides feedback to the user related to the proper position of the kickboard. Indicator 419 as shown is a bubble level that displays to the user the board is level in two directions. Indicator 419 alternatively can be a series of light emitting diodes displaying the output of an attitude sensor such as an accelerometer or rate gyro. While indictor 419 is shown on the upper surface of kickboard it should be apparent that the indictor can be located on the trailing edge of the kickboard.

Member 403 is preferable fabricated from two layers of foam. One of the layers contains a first recess sized to receive first weight 405*a* and a second recess sized to receive second weight 405*b*. An uncured layer of epoxy is disposed between the two layers sandwiching the weights 405 and then pressure is applied to the two layers. Once the epoxy is cured, the pressure is removed and the weighted kickboard 401 is complete. Any texture on the surfaces of weights 405 facilitates the adhesion of epoxy to the weights. Alternatively the kickboard is comprised of three layers of foam, the center layer having the recess for the high density member 105.

A kickboard containing a low density member and a high density member, the kickboard having a weight configured that the kickboard does not float on a body of water and does not sink to the bottom of a body of water thereby providing swimmers with greater resistance during swimming as the weighed kickboard requires more force from the user to maintain proper position.

The weighted kickboard requires the user to engage more muscle groups, including the core muscles, than a regular, non-weighted kickboard. Unlike a standard, non-weighted kickboard which maintains buoyancy even with the weight of a user's arms resting on top, the weighted kickboard floats just beneath the surface and sinks several inches below the surface when a user's arms are applied. So in order to maintain proper body position and alignment on top of the water, a user must engage additional muscles, including the core muscles and latissimus dorsi muscles to propel the user forward. Another shortcoming of the standard, non-weighted kickboard is that its natural buoyancy is so high that the user's hips and legs are forced lower in the water as the board pushes up on the arms and chest. This puts unnecessary pressure on the user's shoulders and is contrary to the ideal body position while swimming. In contrast, the weighted kickboard rests lower in the water, allowing the swimmer to maintain proper body position during kicking drills, which will result in better body position and alignment while swimming, ultimately resulting in faster overall swimming and racing.

To get the most benefit from the weighted kickboard a swimmer would hold the board near the leading edge towards the front of the kickboard, either directly over top of the front or along the sides and towards the front. The arms are extended to reinforce good body position but also to work the core muscles more and thus get the most benefit. Alternatively, a swimmer could do drills to improve swimming technique whereby they hold the end of the kickboard. During regular kickboard training, the kickboard should be held level and just under the surface, again to reinforce good body position and alignment and to make the core muscles work harder.

In general, the increased effort exerted by the swimmer to maintain good body position on top of the water while kicking with the weighted kickboard then makes it easier for the swimmer to swim on top of the water. Swimming on top of the water versus underneath the water is a much faster way to swim, so training with a weighted kickboard translates to faster swimming at the end of the season in a swimmer's big meet. Additionally, the density or weight of the kickboard can be adjusted based upon the swimming proficiency and or age of the user. For example, a user swims a period of time with a standard kickboard after an initial aptitude test, then progresses to a weighted kickboard with a first weight after a second aptitude test with a higher score, then progresses to another weighted kickboard with a second weight higher than the first weight after a third test with a higher aptitude, and so forth. Alternatively, children use a lighter kickboard with a 4 pound plate and adults use a heavier kickboard with a 6 pound plate.

The weighted kickboard can improve general swimming proficiency as well as improve the four individual strokes butterfly, backstroke, breaststroke, and freestyle, in ways that a standard, non-weighted kickboard cannot. For example, dolphin kick is extremely important in swimming and swim training as it is allowed in three of the four competitive strokes. One big benefit of the board is that it can easily remain submerged by the person using it, allowing it to be used for underwater dolphin kick training. In this type of training the weighted kickboard would stabilize the front of a swimmer's body while the core, hips, and legs did the majority of the work, thereby resulting in a superior dolphin kick. A standard, non-weighted kickboard cannot do this, as it is too buoyant to stay submerged and will pull the user up to the surface. The weighted kickboard also improves speed in breaststroke, a stroke that is heavily dependent on strong kick. The ability of the weighted kickboard to improve body alignment allows the user to drive their breaststroke kick straight behind them, resulting in stronger, faster propulsion in the water. A standard, non-weighted kickboard cannot do this, as the buoyancy of a standard kickboard raises the upper body in the water, thus pushing the lower body under the water and driving a swimmer's breaststroke kick in a more downwards motion. A downward kick is wasted energy as it does not maximize forward propulsion. Backstroke also requires good body position and alignment which is aided through the use of the weighted kickboard. A user could hold the weighted kickboard across their pelvic region thus forcing the user to engage more core muscles to keep their hips from sinking, which maintains straight body alignment on top of the water and the more ideal position for good swimming. Using a weighted kickboard improves a user's speed while swimming any of the four competitive strokes by exercising muscle groups that are critical to good swimming, and in ways a standard, non-weighted kickboard cannot.

In a sample test of 23 swimmers ranging in age from 8 years old to 65 years old, 21 of the users reported a "significant increase" in the amount of effort exerted by their core muscles in order to maintain good body position while using the weighted kickboard. The remaining 2 swimmers reported a "somewhat increased" level of effort. Furthermore, the majority of users said they noticed an improvement in their swimming immediately after using the weighted kickboard due to a feeling of swimming more on top of the water than underneath it.

It is apparent that an assembly and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A weighted kickboard, comprising:

a first low density member, comprised of foam; and a first high density member located fully inside the first low density member;

wherein the first high density member is a steel plate;

wherein the kickboard is planar;

wherein an entire exterior surface of the weighted kickboard is foam;

wherein the first high density member is attached to the weighted kickboard by epoxy; and wherein the first high density member is rectangular and planar.

2. The weighted kickboard according to claim 1, wherein the weighted kickboard weighs at least 4 pounds.

3. The weighted kickboard according to claim 1, further comprising:

a second high density member located inside the first low density member;

wherein the weighted kickboard weighs at least 4 pounds.

4. The weighted kickboard according to claim 3, wherein the first high density member and the second high density member are configured to selectively locate a center of gravity of the weighted kickboard.

5. The weighted kickboard according to claim 1, wherein a buoyance of the weighed kickboard is configured to keep only an upper surface of the weighed kickboard out of water.

6. The weighted kickboard according to claim 1, further comprising:

a texture located on an exterior surface of the weighted kickboard.

7. A kickboard, comprising:

a first weight;

a first low density member having a first recess sized to receive the first weight;

a second member;

wherein the first low density member and the second member are fabricated from foam;

wherein an entire exterior surface of the kickboard is foam;

wherein the first weight is a steel plate;

wherein the first low density member and the second member are coupled together by an epoxy;

wherein the first weight is coupled to the first low density member by the epoxy;

wherein the first weight is located inside the first low density member;

wherein the kickboard is planar;

wherein the first weight is planar and rectangular having rounded corners;

wherein the first low density member and the second member are coupled together to retain the first weight; and wherein the first weight increases a density of the kickboard.

8. The kickboard according to claim 7, further comprising:

a second weight located inside the first low density member; and a second recess located in the first low density member sized to receive the second weight;

wherein the weighted kickboard weighs at least 4 pounds.

9. The kickboard according to claim 7, wherein the weighted kickboard weighs at least 6 pounds.

10. The kickboard according to claim 7, further comprising:

surface indicia configured to alert a user to the weight of the kickboard.

11. The kickboard according to claim 7, further comprising:

an indicator for providing feedback.

* * * * *